US007883268B2

(12) United States Patent
Steele

(10) Patent No.: US 7,883,268 B2
(45) **Date of Patent: *Feb. 8, 2011**

(54) PACKAGE HAVING A FLUID ACTUATED CLOSURE

(76) Inventor: Mark Steele, 1007 Lexington Ave. North, New Prague, MN (US) 56071

( * ) Notice: Subject to any disclaimer, the term of this patent is extended or adjusted under 35 U.S.C. 154(b) by 402 days.

This patent is subject to a terminal disclaimer.

(21) Appl. No.: 11/737,866

(22) Filed: Apr. 20, 2007

(65) Prior Publication Data

US 2007/0189641 A1 Aug. 16, 2007

Related U.S. Application Data

(63) Continuation of application No. 11/268,674, filed on Nov. 7, 2005, now Pat. No. 7,207,717.

(60) Provisional application No. 60/625,391, filed on Nov. 5, 2004.

(51) Int. Cl.

| | |
|---|---|
| ***B65D 30/22*** | (2006.01) |
| ***B65D 33/10*** | (2006.01) |
| ***B65D 33/16*** | (2006.01) |
| ***B65D 33/00*** | (2006.01) |
| ***B65D 30/16*** | (2006.01) |

(52) U.S. Cl. ..... 383/38; 383/10; 383/204; 383/61.1; 383/95; 383/104

(58) Field of Classification Search ..... 383/3, 383/10, 104, 42, 43, 44, 45, 93, 95, 59, 906, 383/64, 38, 61.1, 203, 204

See application file for complete search history.

(56) References Cited

U.S. PATENT DOCUMENTS 2,460,853 A * 2/1949 Siple ..... 24/585.1
2,715,759 A * 8/1955 Poux ..... 24/400
2,720,903 A * 10/1955 Pickren ..... 206/102
2,785,824 A * 3/1957 Reeves ..... 220/232
2,994,117 A * 8/1961 McMullin ..... 24/585.1
3,025,629 A * 3/1962 Sears ..... 43/55
3,058,187 A * 10/1962 Gugen ..... 24/585.11
3,102,570 A * 9/1963 Fairchilds ..... 383/59

(Continued)

FOREIGN PATENT DOCUMENTS

WO WO 01/51367 7/2001

(Continued)

OTHER PUBLICATIONS

WO 2006/052800 International Search Report attached, May 10, 2007.

(Continued)

*Primary Examiner*—Jes F Pascua
(74) *Attorney, Agent, or Firm*—Skaar Ulbrich Macari, P.A.

(57) ABSTRACT

The package generally includes at least first and second panel portions operably connected to define an interior cavity therebetween. The first panel portion can include a fluid chamber operably disposed along a portion of the first panel portion such that a portion of the fluid chamber is adapted to operably abut or confront the second panel portion to generally block an access opening into the interior cavity. The second panel portion can further include a fluid chamber.

23 Claims, 12 Drawing Sheets

U.S. PATENT DOCUMENTS 3,133,575 A 5/1964 Slemmons
3,151,650 A * 10/1964 Beck ..... 206/568
3,224,640 A 12/1965 Schneider et al.
3,339,721 A 9/1967 Goldstein
3,343,233 A * 9/1967 Gould ..... 24/400
3,367,380 A 2/1968 Dickey
3,390,507 A 7/1968 Repko
3,542,032 A 11/1970 Spencer et al.
3,874,115 A * 4/1975 London et al. ..... 47/41.11
4,155,453 A 5/1979 Ono
4,209,115 A 6/1980 Stahl
4,313,609 A * 2/1982 Clements ..... 277/641
4,519,499 A 5/1985 Stone et al.
4,588,554 A 5/1986 Kaartinen et al.
4,703,518 A 10/1987 Ausnit
4,806,021 A 2/1989 Koudstaal et al.
4,874,093 A * 10/1989 Pharo ..... 206/522
4,877,334 A 10/1989 Cope
4,923,701 A 5/1990 VanErden
5,050,736 A 9/1991 Griesbach et al.
5,080,248 A * 1/1992 Stocchiero ..... 220/232
5,120,553 A 6/1992 Kupcikevicius
5,209,347 A 5/1993 Fabisiewicz et al.
5,335,478 A 8/1994 Aronsen
5,447,235 A 9/1995 Pharo
5,535,888 A 7/1996 De Luca
5,558,438 A 9/1996 Warr
5,743,443 A 4/1998 Hins
5,803,256 A 9/1998 Lydhig et al.
5,882,117 A 3/1999 Laffon
5,941,643 A * 8/1999 Linkiewicz ..... 383/210
6,020,013 A 2/2000 Kozma
6,036,004 A 3/2000 Bowen
6,053,635 A * 4/2000 Anderson et al. ..... 383/10
6,065,873 A 5/2000 Fowler
6,074,096 A * 6/2000 Tilman ..... 383/63
6,164,822 A 12/2000 Beer
6,193,416 B1 2/2001 Kawamata et al.
6,206,571 B1 * 3/2001 Olin ..... 383/204
6,245,367 B1 6/2001 Galomb
6,352,365 B1 3/2002 Healy et al.
6,375,037 B1 4/2002 Bell et al.
6,409,384 B1 * 6/2002 Provan et al. ..... 383/5
6,481,183 B1 11/2002 Schmidt
D468,195 S 1/2003 Bell
6,533,711 B1 3/2003 Anderson et al.
6,572,267 B1 6/2003 Forman
6,616,333 B2 * 9/2003 Kinigakis et al. ..... 383/64
6,629,777 B2 10/2003 Tanaka et al.
6,641,307 B2 11/2003 Matsuda et al.
6,726,364 B2 4/2004 Perell et al.
6,789,945 B2 9/2004 Mobs et al.
6,854,886 B2 * 2/2005 Piechocki et al. ..... 383/59
6,910,995 B2 6/2005 Schneider et al.
6,938,394 B2 9/2005 Perell
6,968,952 B2 11/2005 Crevier et al.
7,040,810 B2 5/2006 Steele
7,048,442 B2 5/2006 Schneider et al.
7,097,092 B1 * 8/2006 Marrale ..... 229/117.35
7,207,717 B2 * 4/2007 Steele ..... 383/38
D549,594 S 8/2007 Steele
7,316,052 B2 * 1/2008 Pawloski et al. ..... 24/585.12
7,340,807 B2 3/2008 Dais et al.
7,585,111 B2 * 9/2009 Turvey et al. ..... 383/63
2001/0030134 A1 10/2001 Goglio et al.
2002/0154835 A1 * 10/2002 Galomb ..... 383/10
2003/0147565 A1 8/2003 Plourde et al.
2003/0219174 A1 * 11/2003 Piechocki ..... 383/59
2004/0031244 A1 2/2004 Steele
2004/0057638 A1 3/2004 Perell et al.
2004/0231292 A1 11/2004 Perell
2005/0069227 A1 3/2005 Steele
2006/0126970 A1 6/2006 Perell
2006/0215942 A1 9/2006 Steele
2007/0278114 A1 12/2007 Kane et al.
2008/0002918 A1 1/2008 Steele
2008/0279485 A1 11/2008 Steele
2008/0286420 A1 11/2008 Domingues et al.
2009/0180716 A1 7/2009 Steele
2009/0208147 A1 8/2009 Steele
2009/0238499 A1 9/2009 Steele
2009/0245699 A1 10/2009 Steele
2009/0277916 A1 11/2009 Steele

FOREIGN PATENT DOCUMENTS

WO WO 2005/123196 12/2005
WO WO 2006/052800 5/2006
WO WO 2008/137937 11/2008

OTHER PUBLICATIONS

WO 2006/052800 International Preliminary Report on Patentability attached, Jun. 19, 2007.
WO 2008/137937 International Search Report attached, Oct. 27, 2008.
WO 2008/137937 International Preliminary Report on Patentability attached, Nov. 10, 2009.

* cited by examiner

PACKAGE HAVING A FLUID ACTUATED CLOSURE

RELATED APPLICATION

This application is a continuation of application Ser. No. 11/268,674 filed Nov. 7, 2005, which claims the benefit of U.S. Provisional Application No. 60/625,391 filed Nov. 5, 2004. Each of the above-referenced applications is incorporated fully herein by reference.

FIELD OF THE INVENTION

The present invention relates generally to flexible packaging and, more particularly, to flexible packages, and methods for manufacturing and using packages, having a fluid actuated closure.

BACKGROUND OF THE INVENTION

Conventional flexible packages generally include external or integrated sliding means or other similar devices designed to allow a user to selectively gain access into the pouch or package. Traditionally, non-integrated, twist ties and other tying means have also been used to close an open-end portion of a flexible package. These devices often require the manufacturing of additional and often costly materials and/or devices into the packages.

Due to the problems associated with external closure devices for packages, the industry has developed integrated closeable devices. U.S. Pat. Nos. 4,913,561, 5,692,837, and 6,186,663 disclose such packaging. Current typical reclosable devises, most commonly known as zippers, tend to be pre-made at separate manufacturing sites and then shipped to the site where the actual package is manufactured. The reclosable device is then introduced into the packaging machinery and typically heat sealed into or onto the package. These reclosable devises usually are comprised of two pieces that have been mated together by male and female interlocking members. The mating process is usually performed by either pinching the two interlocking members together (press-to-close mechanism) or sliding a mechanism (zipper mechanism) along the top of the reclosable device, which causes the two interlocking members to be interlocked.

These press-to-close closure mechanisms are sometimes difficult to align when attempting to mate together, often causing a failure of a true closure. Furthermore, when a packager is filling the package through the press-to-close closure mechanism, and when the consumer is pouring the contents out of the package, small pieces of the product can get caught in tracks of the mating interlocking members and hamper any positive closing operation.

Further, most zipper-type closure mechanisms merely serve to close off the top portion of the package by pulling or forcing together the top portions of the front and back panels of the package. This zipper-type closure mechanism has two significant drawbacks. First, it reduces the internal holding volume of the package since, in a closed position, side gussets of the package are forced to contact at an end proximate the access opening. Second, a space or gap can remain when the zipper-type closure mechanism is in its closed position. The gap permits air to flow in and out of the package. Although the zipper-type closures may be easier for some consumers to operate, and may have a more positive closure with respect to the press-to-close closure mechanism, they can be expensive and, like the press to close closure mechanisms, often do not create an ideal barrier after the package has been opened by the consumer for the first time.

As a result, there is a need for a flexible package that substantially solves the above-referenced problems with conventional package designs, configurations, and manufacturing methods.

SUMMARY OF THE INVENTION

The present invention solves many of the problems facing the flexible packages and packaging industry. Embodiments of the present invention are directed to a package generally including at least one front and back panel joined at least partially together to define an interior accessible through an access opening. The interior is capable of storing and dispensing product and other objects or materials. Further, at least one web member can be joined to each of the front and back panel portions respectively to form at least two generally parallel chambers and/or channels that extend generally along at least a portion of the access opening. In one embodiment, each of the chambers includes a reservoir or storage portion and a closure portion in fluid communication. In a preferred embodiment, a fluid such as a gas (e.g., air), liquid, gel or other like fluid is disposable in each of the chambers during manufacture such that the reservoir portion and/or the closure portion are generally inflated or expanded. A fluid regulator may be formed and/or disposed between the reservoir portion and the closure portion of each of the chambers to regulate the transfer and/or flow of fluid therebetween.

In use, to close the access opening a user squeezes or applies a measurable amount of force or pressure to the inflated reservoir portions. The pressure causes the fluid to flow through to the closure portions of the chambers, and through the fluid regulator if included. The inflow of fluid causes the closure portions to inflate and generally confront or seat against each other and selectively block the access opening. To provide access to the interior of the package, a user may squeeze the closure portions of the chambers, which causes the fluid to flow through the fluid regulator and into the reservoir portions. As the fluid flows into the reservoir portions, the closure portions deflate permitting a user to access the interior of the package.

The above summary of the invention is not intended to describe each illustrated embodiment or every implementation of the invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
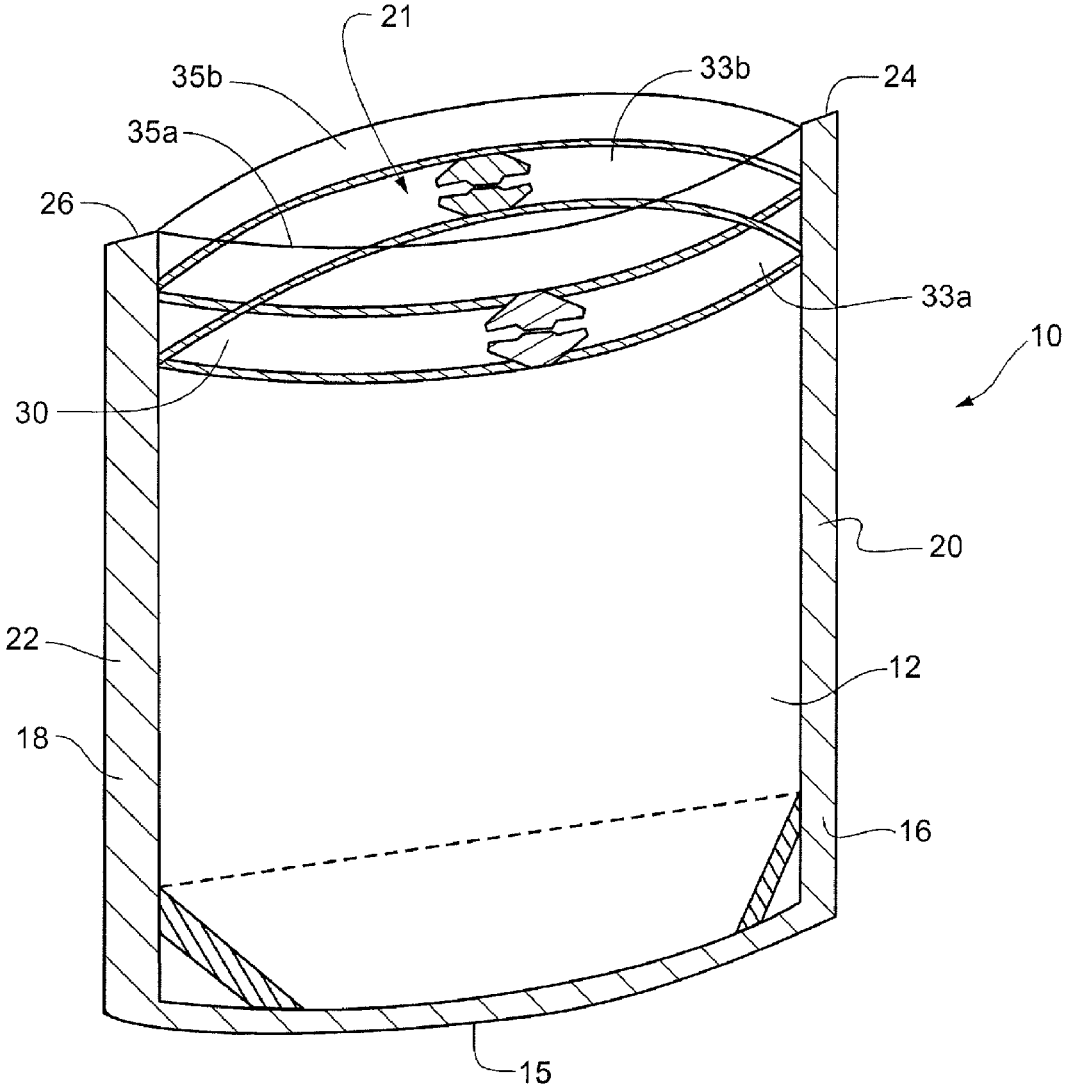
FIG. 1 is a perspective view of one embodiment of a flexible package having a fluid actuated closure mechanism, with the top of the package unsealed.

While the invention is amenable to various modifications and alternative forms, specifics thereof have been shown by way of example in the drawings and will be described in detail. It should be understood, however, that the intention is not to limit the invention to the particular embodiments described. On the contrary, the invention is to cover all modifications, equivalents, and alternatives falling within the spirit and scope of the invention as defined by the appended claims. For illustrative purposes, hatching or shading in the figures is provided to demonstrate sealed portions and/or integrated devices for the package.

DETAILED DESCRIPTION OF THE INVENTION

A purpose of the present invention is to allow for a package, such as a flexible package, to be opened and reclosed with a simple squeezing motion, to maintain a higher barrier against oxygen transmission after the package has been initially opened by the consumer, and/or to provide a one-way release valve, if desired. The various embodiments and teachings provided herein can also be employed with a rigid or semi-rigid package.

Figure 3:
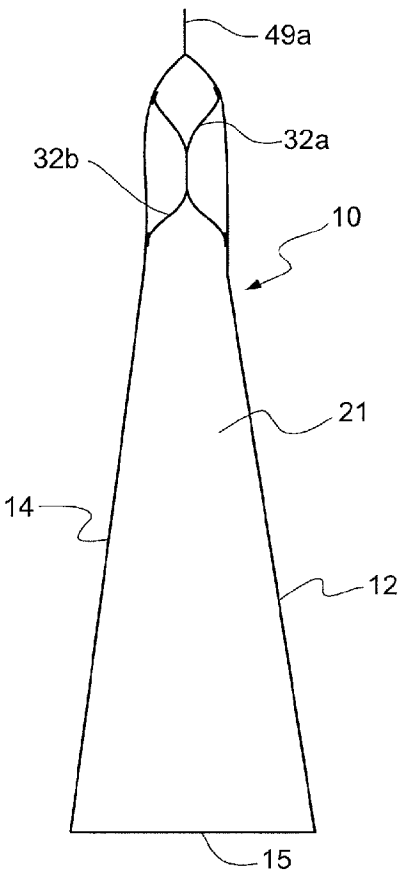
FIG. 3 is a cross-section view of the embodiment of FIG. 2 having an inflated closure portion and a top seal.
Figure 2:
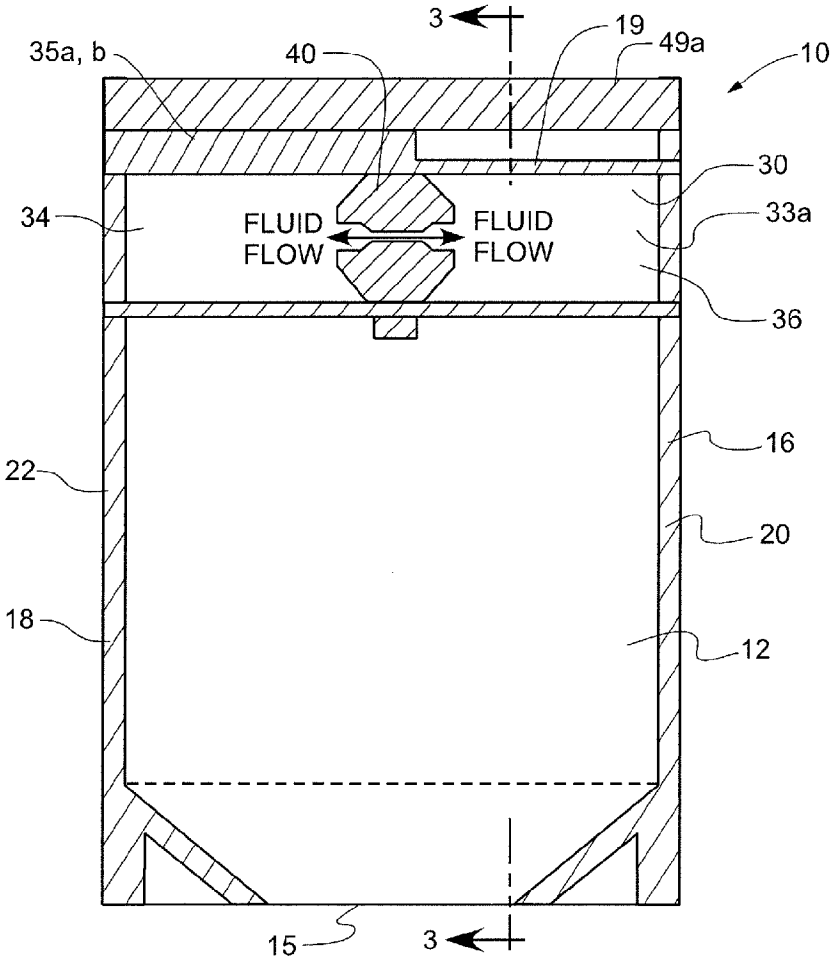
FIG. 2 is a front view of one embodiment of a flexible package having a fluid chamber with a reservoir portion and a closure portion.

Referring generally to FIGS. 1-16, a flexible package 10 in accordance with the present invention is shown. Referring generally to FIGS. 1-3, the package 10 generally includes a front panel portion 12, a back panel portion 14. Further, a bottom panel portion 15, gusseted or non-gusseted, can be included, especially in those embodiments defining a stand up package. The joining and/or shaping of the panels 12, 14, 15, generally define an inner cavity 21 having an adjustable internal volumetric capacity. The inner cavity 21 is capable of storing, transporting and/or dispensing product or other objects and material therein. Side panel portions (not shown), gusseted or non-gusseted, may also be included. The panel portions 12-15 are often referred to as webs, films or layers.

The package panel portions 12-15 are generally constructed of a flexible sheet material such as polyethylene, polyester, metal foil, polypropylene, or polyethylenes laminated with other materials such as nylon, polyester, and like films. To provide for higher barriers, embodiments can use combination layers of said materials and materials of the like. Generally, in such embodiments, a material having preferred sealing characteristics can be joined or bonded to a material having a different preferred characteristic (i.e., beneficial oxygen barrier properties). Preferably, the package of the present invention is to be formed into a stand-up pouch, but it could be a pouch that displays lying down, or in other package and pouch shapes and configurations known to one skilled in the art.

In one embodiment, the front panel portion 12 and the back panel portion 14 will be formed of one contiguous web material. In alternative embodiments, at least one of the panel portions 12-15 can be distinct web materials joined or sealed to other respective panel portions to form the package 10 of the present invention. For instance, the front panel portion 12 and the back panel portion 14 can be joined to each other from distinct non-contiguous web sheets of material, and one of said panel portions 12-14 can further extend to define the bottom panel portion 15. The bottom panel portion 15 in the various configurations forming a stand up pouch can include a gusset known to those skilled in the art to further promote operative expansion and contraction of the package 10 and its respective capacity in accordance with the receipt and removal of material within the package 10.

The front panel portion 12 generally includes a first front longitudinal edge 20 and a second front longitudinal edge 22. Both of said front panel longitudinal edges 20, 22 are substantially parallel to each other and extend along the longitudinal length of the front panel portion 12. Likewise, the back panel portion 14 generally includes a first back longitudinal edge 24 and a second back longitudinal edge 26, also substantially parallel to each other and spanning the longitudinal length of the back panel portion 14.

In one embodiment, the first front longitudinal edge 20 can be sealably joined to the first back longitudinal edge 24 along the length of the edges 20, 24 to form first side seal 16. Similarly, the second front longitudinal edge 22 can be sealably joined to the second back longitudinal edge 26 along the length of edges 22, 26 to form second side seal 18. These side seals 16, 18 generally define the side boundaries of the package 10 and can be sealably joined using heat, adhesive, and other bonding techniques known to one of ordinary skill in the art.

Referring to FIGS. 1-4, the flexible package 10 includes a fluid actuated closure 30 attached to or integrated to the flexible package 10 to permit a user to selectively reclose the access opening 19. In one embodiment of the invention, the fluid actuated closure 30 includes at least one first web barrier or layer 32*a* joined to an inner surface of the front panel portion 12 of the package 10 and at least one second web barrier or layer 32*b* joined to an inner surface of the back panel portion 14 of the package 10, such that the first 32*a* and second 32*b* web barriers are generally opposed. It is also envisioned that an alternative embodiment of the present invention can include only one web barrier or layer 32*a* joined to an interior of a panel portion (e.g., front panel portion 12), such that the barrier 32*a* confronts the interior of the opposing panel portion (e.g., back panel portion 14) or some other structure of the package 10 to provide selective opening and closing of the package 10 through sealing of the access opening 19 as described herein.

The front 12 and back 14 panel portions and the first 32*a* and second 32*b* web barriers can define at least two fluid chambers or tubes 33*a* and 33*b* that extend generally along a long axis of the access opening 19, generally transverse to the side seals. In another embodiment, the fluid chambers 33*a* and 33*b* may be a laminate formed by trapping or positioning a barrier film between two layers of a sealant film, preferably a Nylon or EVOH barrier film co-extruded between two layers of polyethylene. The fluid chambers 33*a* and 33*b* are sealed into the top section of the package 10 where typically air, or gas, liquid, or a similar item, is introduced between the first web barrier 32*a* and the front panel portion 12 of the package 10 and between the second web barrier 32*b* and the back panel portion 14 of the package 10, or if using tubes, it will be introduced into the tubes. This will create one or more generally opposed balloon type bubbles in a top portion or section of the package 10. Further, the barrier or layers 32*a*, 32*b* and corresponding chambers 33*a*, 33*b* can be formed from a portion of the package 10, such as by folding a part of the package 10 or the respective panels 12, 14 over to create a fluid containable chamber or layer.

Each of the fluid chambers 33*a* and 33*b* may include one or more reservoir or storage portions 34 and one or more closure portions 36 in fluid communication. As shown in the package 10 of FIGS. 1, 2 and 4, portions 35*a*, 35*b* of the package above the respective reservoir portions 34 of the chambers 33*a*, 33*b* are joinable from edge 22 to a point generally short of edge 20, preferably proximate a fluid regulator 40, using known joining or sealing techniques. As such, access into the internal cavity 21 of the package 10 is generally limited to the access opening 19 proximate the closure portion 36 as the portion above the reservoir portion 34 is closed off. Other embodiments are envisioned where the access opening 19 and portions 34, 36 are positioned elsewhere along the package 10 (e.g., along one or more of the side, or front and back panels).

The fluid regulator 40 may be formed and/or disposed between the reservoir portion 34 and the closure portion 36 of each of the chambers 33*a* and 33*b* to regulate the transfer and/or flow of fluid therebetween. The fluid regulator 40 may simply be a narrow channel of two opposing but proximate film portions or materials, various one-way or two-way valve devices, or a myriad of other known regulators or methods and techniques of regulating fluid flow through such channels known to one of ordinary skill in the art. Generally, movement of the fluid from the reservoir portion 34 into the closure portion 36 of each of the fluid chambers 33*a* and 33*b* seals the access opening 19 of the package 10. The opening 19 is sealed due to the conforming abutment or seating of the inflated portions 36 against one another. Likewise, movement of the fluid from the closure portion 36 of each of the fluid chambers 33*a* and 33*b* into the reservoir portion 34 unseals the access opening 19 of the package 10.

In one embodiment of the invention, the reservoir portion 34 and the closure portion 36 of each of the fluid chambers 33*a* and 33*b* may each be at least partially filled with fluid. In this particular state, the access opening 19 may be partially unsealed or opened, which would allow a user or packager to deposit a product or good into the interior of the package 10. To completely seal the access opening 19, a user may exert a force upon the reservoir portion 34, such as by a squeezing motion, to move generally all of the fluid from the reservoir portion 34 into the closure portion 36 of each of the fluid chambers 33*a* and 33*b*. Further, a plurality of generally distinct chambers 33*a*, 33*b* or bubbles/tubes can be implemented to achieve such partial closure or opening such that the access opening is opened or closed in steps according to the number or size of the chambers 33*a*, 33*b*. Such an embodiment can provide a plurality of bubbles or chambers that can provide progressive or stepped inflation or deflation and, thus, progressive or stepped opening or closing of the package at the access opening 19. As illustrated in FIG. 3, when generally all of the fluid is disposed in the closure portions 36 they selectively block and positively seal the access opening 19. To facilitate closure, the closure portion 36 of each of the fluid chambers 33*a* and 33*b* does not necessarily need to be fully inflated to high volumes of pressure, as only enough pressure to seat or abut the chambers 33*a*, 33*b* against each other is necessary.

Figure 4:
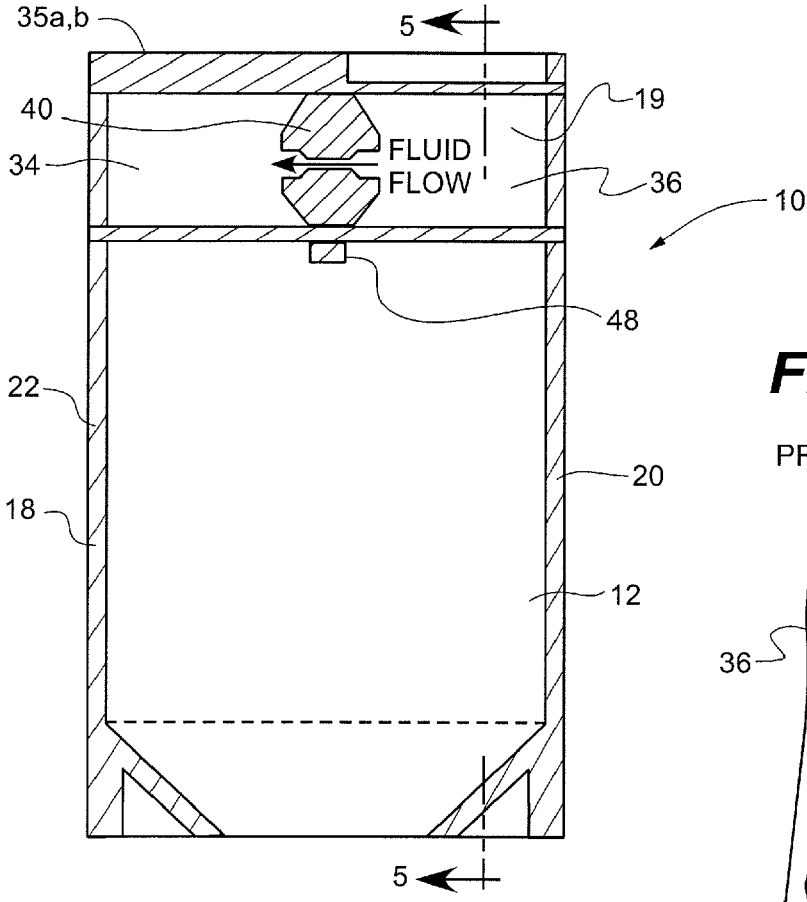
FIG. 4 is a front view of one embodiment of a flexible package having the fluid actuated closure without a top seal.
Figure 5:
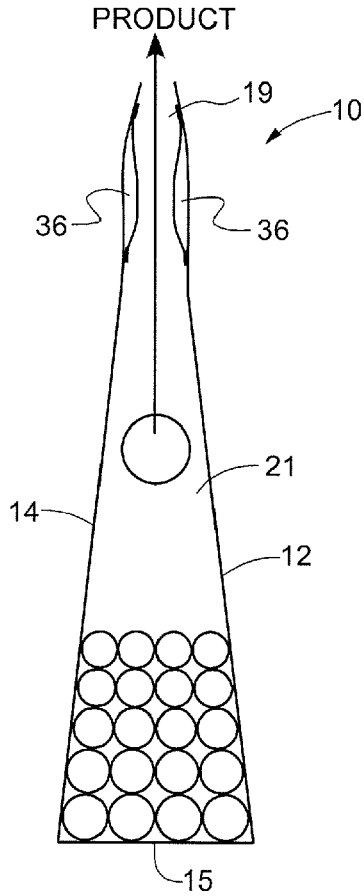
FIG. 5 is cross-section view of the embodiment of FIG. 4 with the fluid actuated closure in an opened or deflated state.
Figure 6:
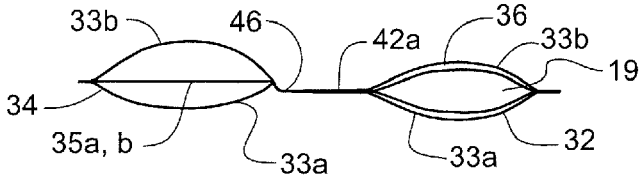
FIG. 6 is a top view of the embodiment of FIG. 3 having a fluid actuated closure mechanism in an opened or deflated state.

To access the interior of the package 10 a user needs to move the fluid from the closure portion 36 of each of the fluid chambers 33*a* and 33*b* into the reservoir portion 34. To move the fluid from the closure portion 36 to the reservoir portion 34 a user exerts a force upon the closure portion 36 of each of the fluid chambers 33*a* and 33*b*, such as by a squeezing motion. As illustrated in FIGS. 4-6, the closure portion 36 of each of the fluid chambers 33*a* and 33*b* begin to deflate as the fluid flows through the regulator 40 and into the reservoir portion 34. When the closure portion 36 of each of the fluid chambers 33*a* and 33*b* are deflated the access opening 19 is unsealed and the contents of the package 10 are accessible. The contents of the package may include solid or fluid product.

Figure 7:
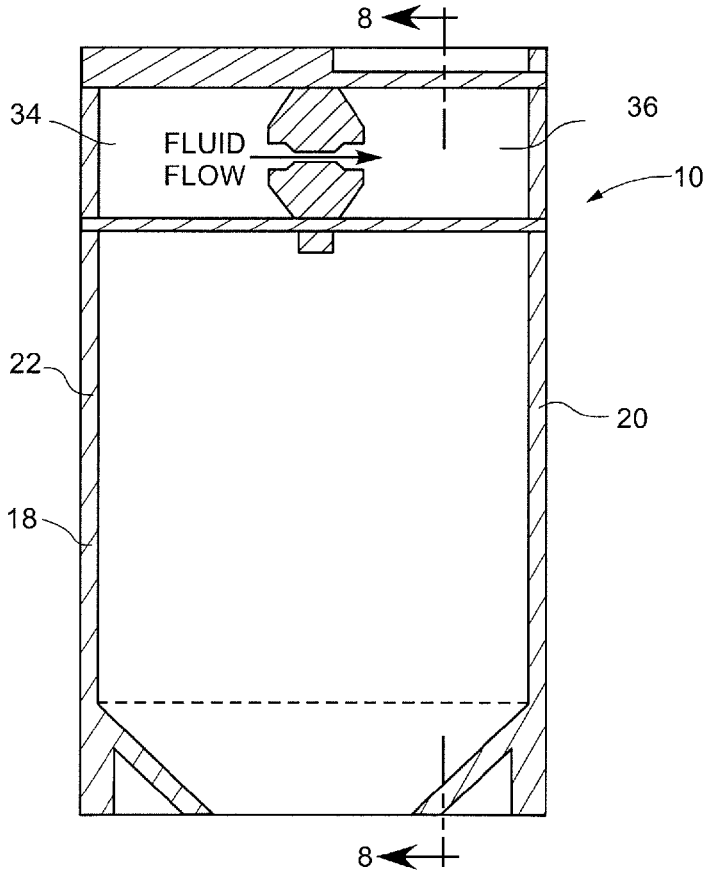
FIG. 7 is a front view of one embodiment of a flexible package with the fluid actuated closure in a closed position.
Figure 8:
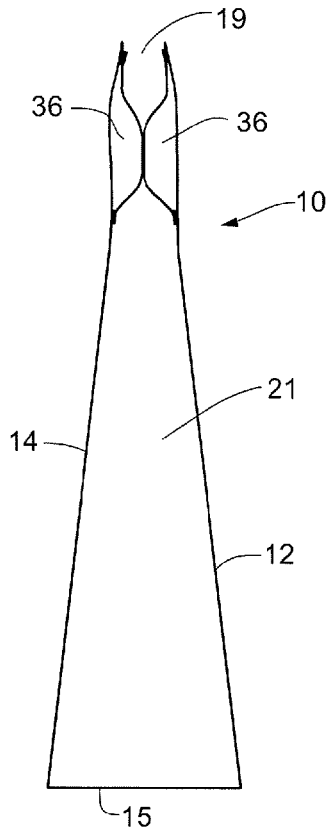
FIG. 8 is a cross-section view of the embodiment of FIG. 7 illustrating the fluid actuated closure in a closed or inflated state.
Figure 9:
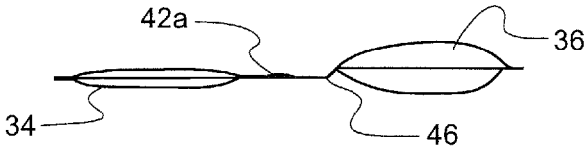
FIG. 9 is a top view of one embodiment of a flexible package having a fluid actuated closure in a closed position.

As illustrated in FIGS. 7-9, the package 10 may be resealed by squeezing the reservoir portion 34 at the top of the package 10, which causes the fluid to flow through the fluid regulator 40 and into the closure portion 36 of each of the fluid chambers 33*a* and 33*b*. As illustrated in FIGS. 8 and 9, as the closure portion 36 of each of the fluid chambers 33*a* and 33*b* fill or inflate the first 32*a* and second 32*b* barrier films between the front 12 and back 14 panels begin to compress and conform to each other, leaving no gaps, or substantially no gaps, for oxygen to pass or escape between them. This barrier feature is enhanced by the abutting nature of the chambers 33*a*, 33*b* and/or the material construction of the chambers (e.g., laminate or other material having oxygen barrier properties). The content of the package 10 can be kept fresher, for longer periods of time; even after the package 10 has been initially opened by the user. Materials and films having such barrier protective properties are known in the art and are envisioned for implementation with the present invention.

In one embodiment of the invention, at least one of the first 32*a* and second 32*b* barrier films, or the material defining the fluid regulator 40, can be made from a material having a high surface energy or static charge, such as saran polyvinylidene chloride or other like films and materials that have a tendency to adhere and/or cling to themselves or other objects. As such, the opposing chambers 33*a*, 33*b* are generally drawn in together when proximately positioned. In this embodiment, the combination of the inflation of the closure portion 36 of the fluid chambers 33*a* and 33*b* and the increased adhereability and/or clingability of the first 32*a* and second 32*b* barrier films ensures positive sealing of the package 10 when an object is disposed generally between the inflated closure portion 36 of the fluid chambers 33*a* and 33*b*. In another embodiment, the chambers can simply be strips 33*c*, 33*d* of such high energy material (not necessarily forming a chamber or tube) such that each strip 33*c*, 33*d* tend to cling or attract towards one another to provide a cling seal to provide for selective access into the package 10 and its contents. As such, the strips 33*c*, 33*d* draw toward one another to provide the seal, but can be easily removed or separated to provide access to the inner cavity 21. These strips 33*c*, 33*d* can run across the entire length of the top of the package 10, or just along a portion of the package 10 proximate the access opening 19. Other embodiments can utilize adhesives or other means of drawing or adhering the films or chambers together.

Figure 10:
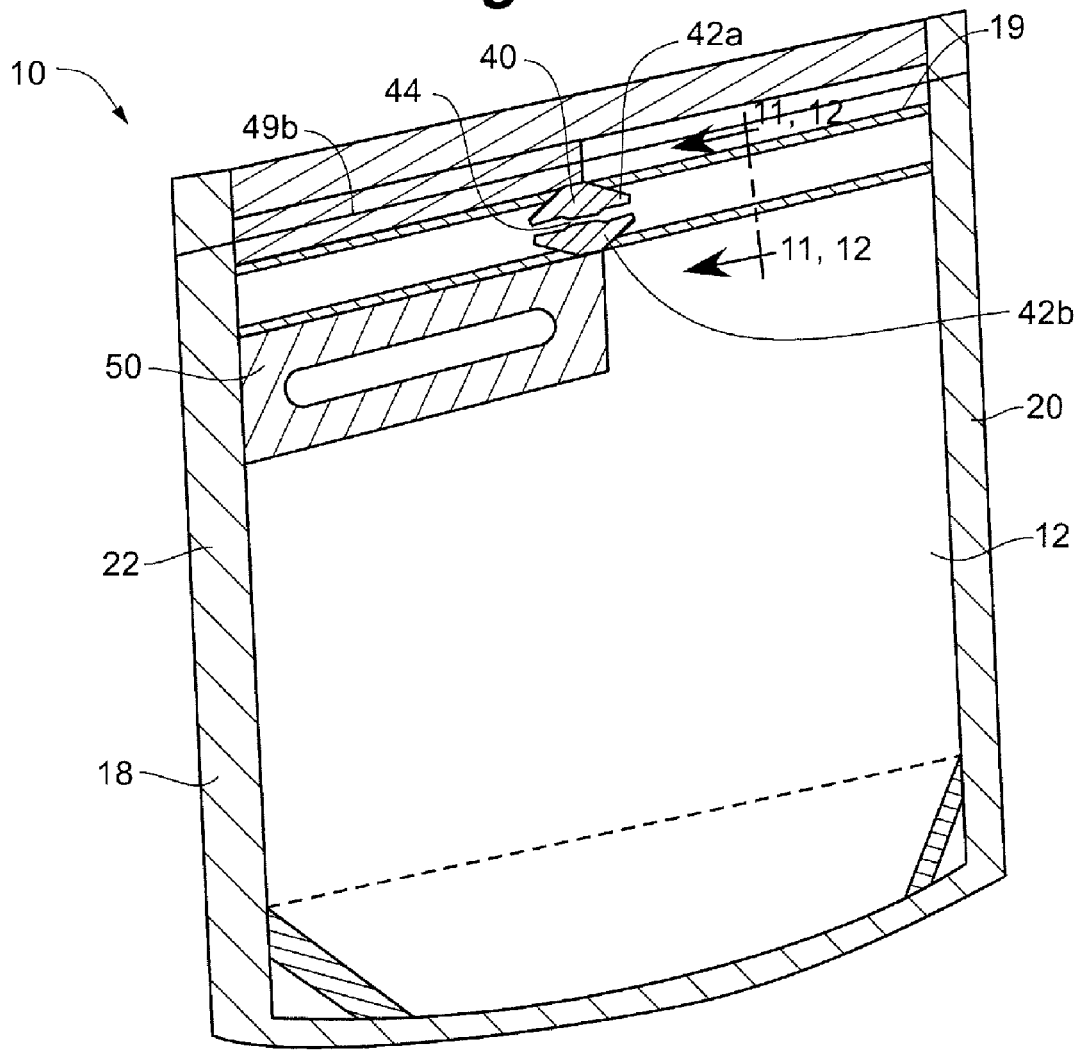
FIG. 10 is a front view of one embodiment of a flexible package having an integrated handle for carrying the package and a fluid regulator.
Figure 11:
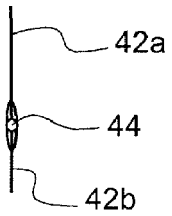
FIG. 11 is a cross-section view of FIG. 10 illustrating an embodiment of the fluid regulator in a closed position.
Figure 12:
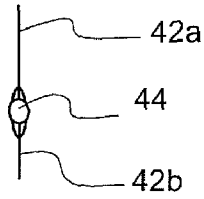
FIG. 12 is a cross-section view of FIG. 10 illustrating an embodiment of the fluid regulator in an open position.
Figure 13:
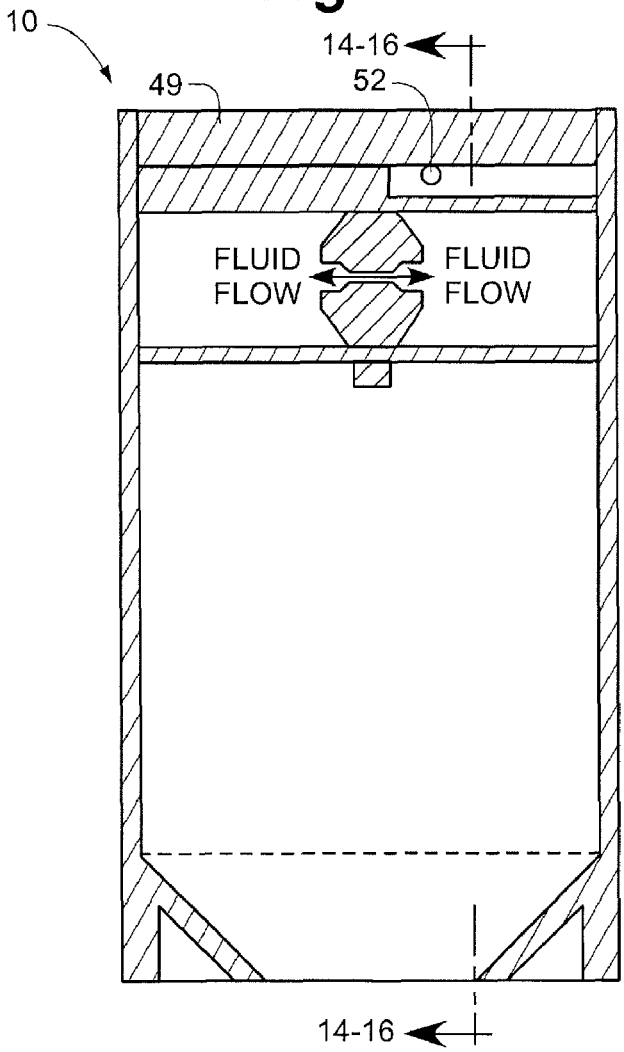
FIG. 13 is a front view of one embodiment of a flexible package having a fluid actuated closure and pressure outlet or vent.
Figure 14:
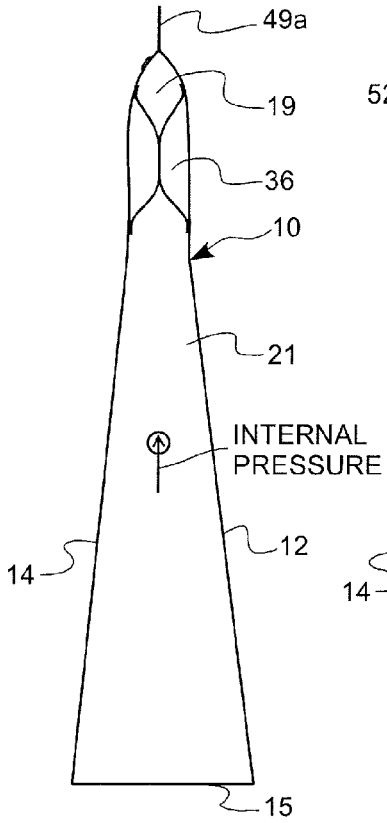
FIG. 14 is a cross-section view of FIG. 13 illustrating a generally higher internal pressure relative to an external pressure.

Referring to FIGS. 10-12, the fluid regulator 40 of each of the fluid chambers 33*a* and 33*b* may be disposed approximately halfway between each side of the package 10, although any percentage or distance across the package 10 is envisioned as long as there are sufficient air/bubble areas for the closure portion 36 and the reservoir portion 34. In one embodiment of the invention, as illustrated in FIGS. 11 and 12, the fluid regulator 40 may be formed by creating a partial sealed area or areas 42*a* and/or 42*b* generally across or along each of the fluid chambers 33*a* and 33*b*. As illustrated in FIGS. 11 and 12, a fluid restriction channel 44 may be formed between the partial sealed areas 42*a* and 42*b*. The fluid restriction channel 44 may have a generally constricted state, as illustrated in FIG. 11, such that fluid is not permitted to flow through without the application of a force (manual, mechanical, etc.) on the inflated reservoir portions 34 or closure portions 36. Upon the application of a force, or other means of moving the fluid, the fluid restriction channel 44 may expand or open to permit the fluid to flow, as shown in FIG. 12. The partially sealed area or areas 42*a* and/or 42*b* may be of any shape and size which selectively restricts the flow of fluid between the reservoir portion 34 and the closure portions 36 of the fluid chambers 33*a* and 33*b*. Other types of valves and fluid regulating mechanisms known to one skilled in the art may also be utilized to regulate the flow of fluid between the chambers or package portions.

In an embodiment of the invention, as illustrated in FIGS. 6 and 9, fluid movement between the reservoir portion 34 and the closure portion 36 may be restricted by creating a kink or bend 46 in the fluid chambers 33*a* and 33*b*. In an example embodiment, the kink 46 is formed when the fluid in one fluid chamber 33*a* or 33*b* is greater than the other. The fluid in the opposing fluid chamber 33*a* or 33*b* causes the fluid chamber 33*a* or 33*b* with more fluid to push further against the fluid chamber with less fluid, causing the kink 46 and restricting fluid flow across the portions 34, 36. In another embodiment, the fluid restriction channel 44 and kink 46 may be utilized together to ensure restriction of a flow of fluid between the reservoir portion 34 and the closure portion 36 of the fluid chambers 33*a* and 33*b*.

An intermediate seal 48 may be made just above and potentially just under the kink 46 and/or fluid restriction channel 44 in the fluid chambers 33*a* and 33*b*, as shown in FIG. 4. The intermediate seal 48 will seal the front 12 and back 14 panels of the package 10 together and ensure that they cannot separate except where the fluid closure portions 36 of the fluid chambers 33*a* and 33*b* permit upon fluid movement. Furthermore, the intermediate seal 48 may be a dividing point between a side of the package 10 that will be accessible to the product, and a non-accessible side. The fluid restriction channel 44 and the fluid closure portion 36 of each of the fluid chambers 33*a* and 33*b* can be different sizes and shapes to fit the particular needs and functions of the package size and shape being used for a particular product.

Referring to FIGS. 2-3, and 13-16, a top seal 49*a* may be formed in the front 12 and back 14 panel portions (generally after packaging of the product/contents) to seal the access opening 19 of the package 10. A perforation, laser score, or tear line 49*b* may be formed or identified along a length of the top seal 49*a* to permit a user to easily remove or tear open the top seal and access the interior of the package 10 through the access opening 19. Other forms of sealing, such as peal and seal closures, slits, perforations, and the like can be incorporated with the package 10 and its inventive fluid actuated closure.

In one embodiment of the invention, as illustrated in FIG. 10, a carrying device or handle 50 may be joined to or formed on the package 10. The handle 50 may be disposed or sealed generally adjacent to at least one of the fluid chambers 33*a* and 33*b* and may have a planar surface generally parallel to the front 12 and/or back 14 panels. During use, the handle 50 may be folded generally upward for carrying the package. The handle 50 may be any size and shape. Additionally, the handle 50 may be made of multiples layers or a barrier material similar to other portions of the package 10 to add additional strength and reinforcement. This design also allows the handle to remain on the package after the consumer removes the top seal 49*a* to access the product.

Figure 15:
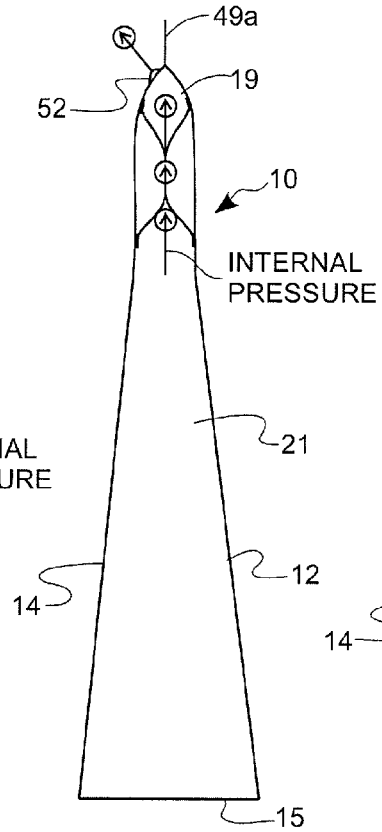
FIG. 15 is a cross-section view of FIG. 13 illustrating an escaping internal pressure through the fluid actuated closure and the pressure outlet or vent.
Figure 16:
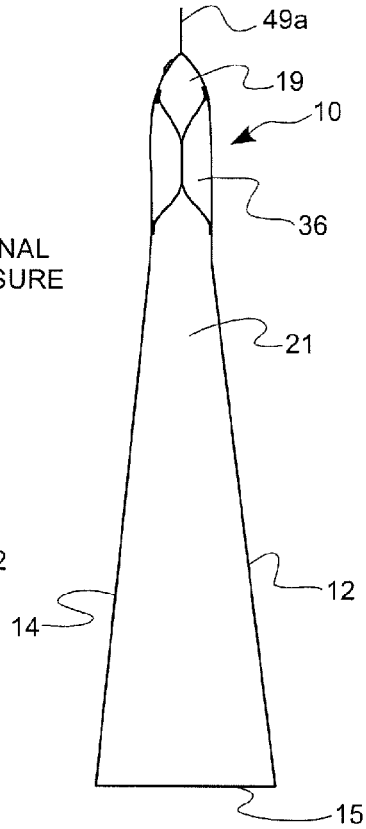
FIG. 16 is a cross-section view of FIG. 13 illustrating a resealing or reseating of the fluid actuated closure upon equalization of the internal and external pressure.

In another embodiment of the invention, as illustrated in FIGS. 13-16, a portion of the front 12 or back 14 panels may include an outlet or aperture 52 to permit a gas in the package 10 to escape. When the closure portion 36 of the fluid chambers 33*a* and 33*b* are inflated, they can act as a release valve for internal products which produce a build up of gas or vapors (e.g. packaged coffee), keeping the package 10 from rupturing while preventing oxygen from outside the package 10 from getting in. As illustrated in FIG. 15, as the gas or vapor builds in the package 10, depending on the material makeup of the chambers 33*a*, 33*b* or the closure portion 36, it will be able to force its way between the two opposing closure portions 36 and escape through the outlet 52. As illustrated in FIG. 16, once the pressure created by the gas or vapor has been released, the closure portions 36 of each of the fluid chambers 33*a* and 33*b* can re-seat against one another, keeping any unwanted oxygen or other fluids from entering the package 10 through the access opening 19.

In other embodiments of the invention, the fluid chambers 33*a* and 33*b* can include a series of smaller fluid chambers or bubbles, long skinny rows of bubbles, or shaped bubbles that compress and or interlock/nest against each other. Depending on the access opening 19 size, and the degree or progressive nature of the closure, different bubble shapes and configurations can be employed.

Although the descriptions noted above are typically for pre-made package formats, it is also envisioned that someone skilled in the art could use this same method on form, fill, and seal machinery, or other packaging machines known to one of ordinary skill in the art. This closure method can be used on virtually any style package; including side gusseted packages, or other packages with transversely applied access devices, tie slits, discrete compartments, and the like. Examples of such packages are taught in U.S. patent application Ser. Nos. 10/396,295, 10/456,971 and 10/954,153, which are co-pending applications of the Applicant and are hereby incorporated by reference in their entirety herein. The tubes/chambers taught herein are generally envisioned for implementation during the manufacturing or forming of the package and/or during the packaging of the product. However, it is also envisioned that they could be preformed and introduced into the package during the manufacturing of the package and/or during the filling of the product into the package. The fluid chambers 33*a* and 33*b* or tubes can be preformed and/or pre-filled with air and could be pre-applied to the main package web or material either along or transversely to a machining or web direction of the package. In addition, the reservoir portions 34 and closure portions 36 can be provided along the side of the package, the bottom, the top, or a combination thereof. For instance, the reservoir portion 34 could be position along the side of the package proximate the longitudinal edges 20, 24, while the access opening 19 remains proximate the top of the package. Other variations and selective positioning for the portions 34, 36 are envisioned as well.

In one embodiment, the package 10 can include a pinching or closing-off device (not shown) positioned internally or externally to the package 10 to close off the fluid regulator 40 or its channel 44. Such a device can prevent fluid transfer between the reservoir 34 and closure 36 portions and can be actuated, engaged or otherwise utilized when it is necessary to prevent such fluid transfer during shipment, storage, use, etc. If, for instance, pressure is applied to the package 10 or its portions 34, 36 during shipment or storage, the fluid transfer will be restricted, thus preventing inadvertent opening of the package at the access opening 19. One exemplary embodiment will include an external clip device that will pinch the regulator channel 44 to close off fluid communication between the portions 34, 36 of the chambers 33*a*, 33*b*.

Additionally, various handles, valve devices, graphics or indicia, closeable and re-closeable devices, gusseted panels or portions, and like features or devices known to one skilled in the art are also envisioned for use with this invention and can be implemented without deviating from the spirit and scope of the present invention. All references to front, back, bottom, and the like are merely for demonstrative purposes and are not intended to limit the variations and positional references and orientations of the panels or the fluid actuated closure of the present invention.

Figure 17:
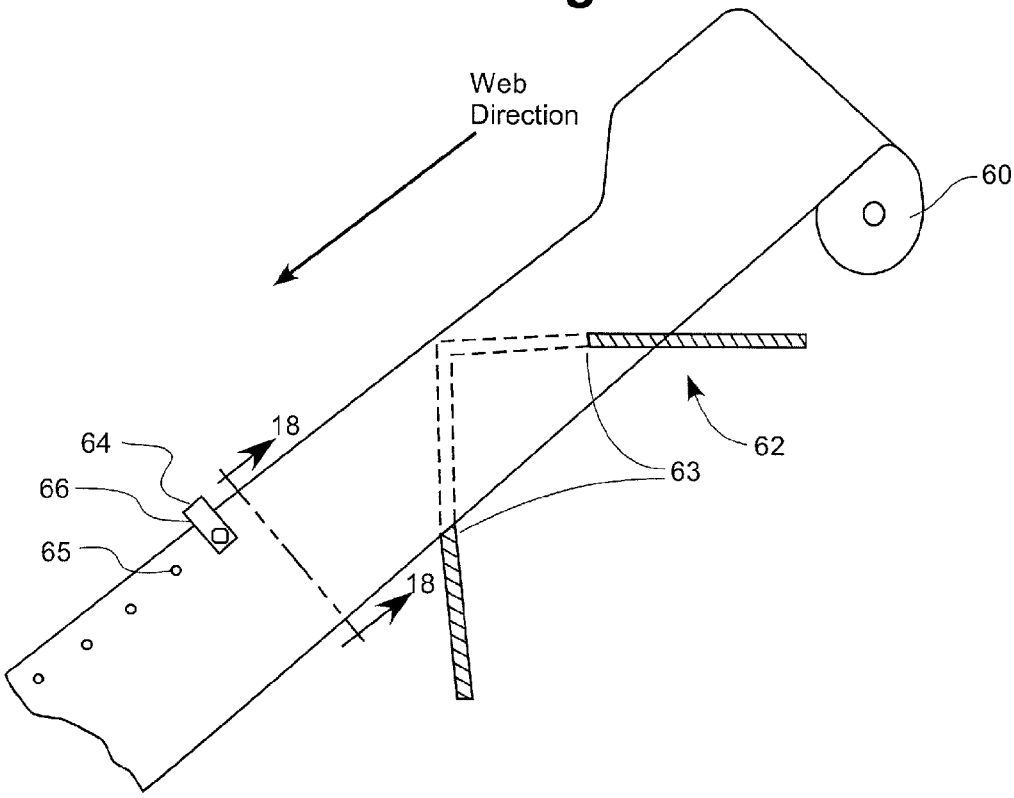
FIG. 17 is top view of web feeding and folding methods in accordance with an embodiment of forming a package.
Figure 18:
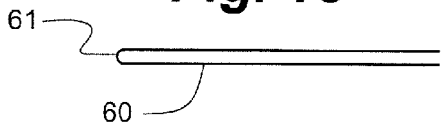
FIG. 18 is a cross-section view of the folded web of FIG. 17.

Referring generally to FIGS. 17-26, a method of forming the package 10 with a fluid closure device 30 provided therewith is depicted. Although a myriad of methods, machinery and techniques may be used for forming the package 10, one embodiment will include utilizing a film or web 60, such as a laminate or co-extruded roll of material 60, that will define the portions of the package 10, such as the front, back, and bottom panel portions. The roll 60 is generally installed on the back of a package forming machine and threaded through the machine to direct the roll along a web or machining direction, as shown in FIGS. 17-18. First, a fold station 62 can fold the web 60 in half, where a sealant layer of the web lamination 60 is folded to face itself. The fold station 62 can include a v-fold device 63 adapted to fold the web 60 over. This fold creates a fold line 61 along the web 60. The web 60 is then pulled through the machine with a series of draw rollers, or other devices and mechanism known in the art, until reaching a punch station 64. The punch station 64 can include a punch device 66 that will punch a hole 65 in the web 60, for later use in tacking the bottom corners of the package (e.g., for a stand-up pouch) 10 together such that the sealant layer of the front panel portion 12 seals to the sealant layer of the back panel portion 14 through apertures in the bottom panel portion 16 (such as a gusseted bottom in a stand-up pouch design).

Figure 19:
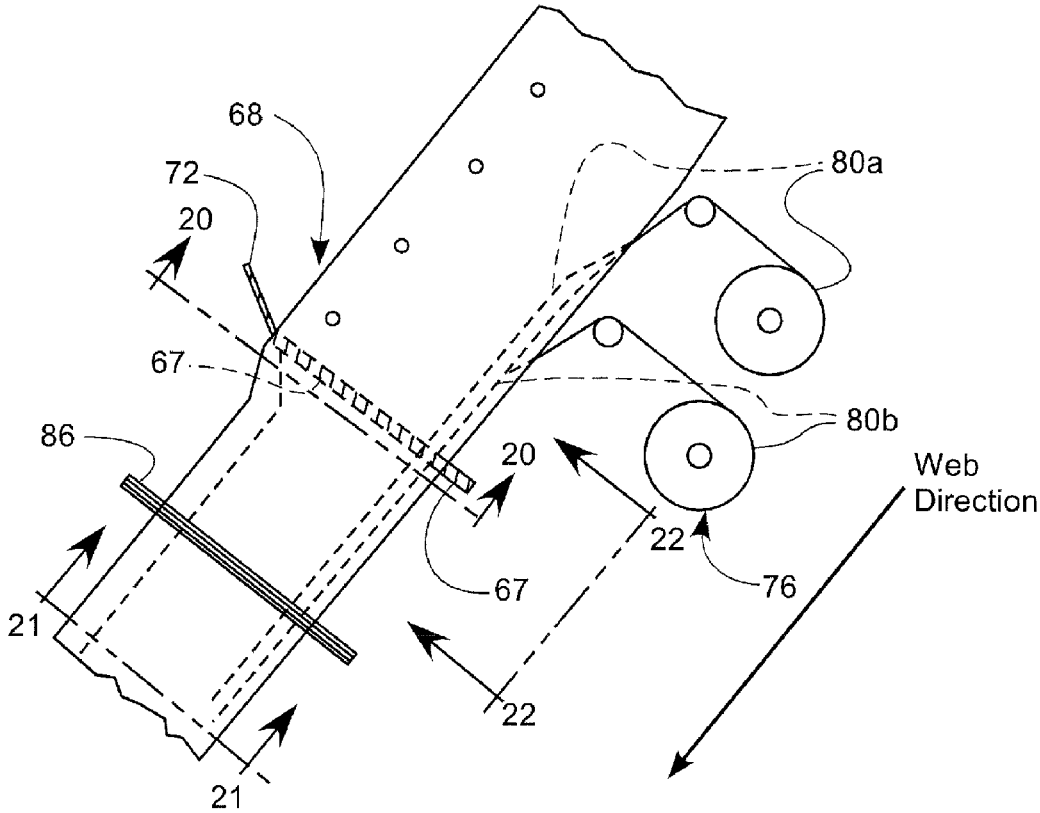
FIG. 19 is a top view of web tucking and collapsing methods in accordance with an embodiment of forming a package.
Figure 20:
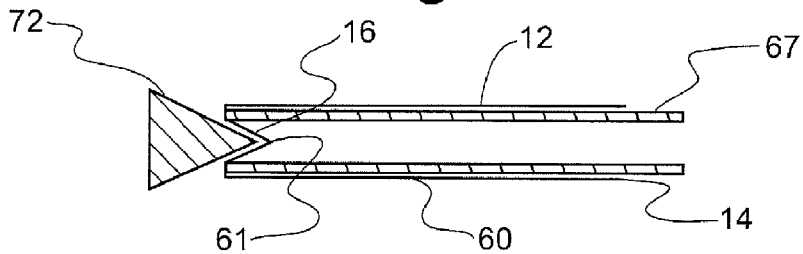
FIG. 20 is a cross-section view of the tucked web of FIG. 19.

As shown in FIGS. 19-20, the continuous folded main web 60 is then opened or spread out at an opener 67, such as by stacked rollers or other known means or techniques. The opener can protrude into the open end or side of the folded web 60 and stop a measurable distance (e.g., several inches) short of the fold line 61 of the material 60. The web 60 can also be fed through a tucking station 68. A plow 72, such as a triangular shaped bracket, located external to the web 60 is then positioned to push the fold 61 into the web 60, as shown in FIG. 20. This forms a gusseted bottom panel 16 for the package 10. While the top and bottom of the folded web, which will later be the front 12 and back 14 panel portions of the package 10, are spread apart, prior to their collapse back together when the bottom 16 is tucked in, two separate rolls of material 80*a*, 80*b*, which will be the chambers or webs 33*a*, 33*b*, are introduced at a fluid chamber station 76. Alternatively, the materials 80*a*, 80*b*, and thus chambers 33*a*, 33*b*, could be pre-applied to the web 60, or a portion of the package 10, prior to formation or feeding of the web 60 through the formation process.

Figure 21:
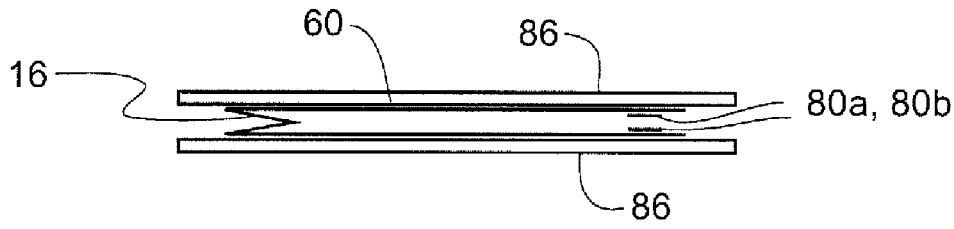
FIG. 21 is a cross-section view of the web of FIG. 19 showing a collapsing method.
Figure 22:
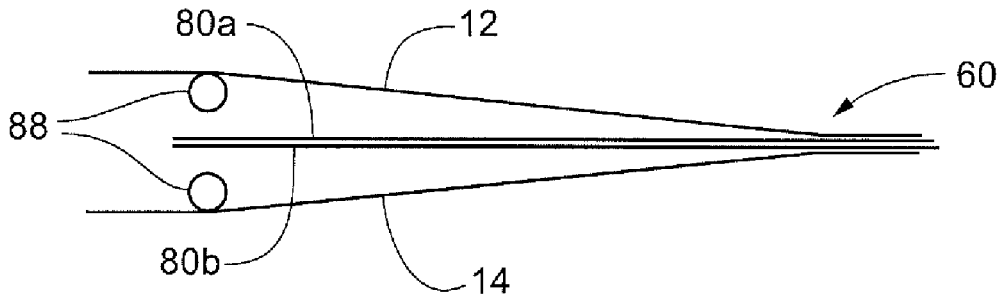
FIG. 22 is a side view of the web of FIG. 19 showing the web and fluid chambers.

At the fluid chamber station 76, the material 80*a*, 80*b* (forming chambers 33*a*, 33*b* in the formed package 10) is introduced at the opened portion of the fold opposite the fold line 61, between the portions of the web 60 that will define the panel portions 12, 14, as shown in FIG. 19. As provided herein, the chambers 33*a*, 33*b* can be tube chambers or material that is unwound from a flat sheet for guidance over a device such as a folding bracket. The material 80*a*, 80*b* can be folded in half with the folded edge/line toward the inside of the web 60 being formed. Because these fluid chambers 80*a*, 80*b* can be made up of a barrier layer sandwiched between two sealant layers as described herein, their formation into a tube or along the fold will facilitate sealing to the package/web 60 and themselves. Heat, adhesive or pressure can be applied to provide the seal. Other techniques for including or attaching the chambers 33*a*, 33*b* to the package 10 to provide the fluid chambers and their respective level of fluid communication are envisioned with the present invention. A collapsing bar 86 can be utilized to collapse the web 60 and chambers 80*a*, 80*b* down or inward, as shown in FIG. 21. Further, rollers 88 can be incorporated at this point in the formation process to separate the chambers 80*a*, 80*b* a distance from the web 60 and its corresponding panels 12, 14, as shown in FIG. 22.

Figure 23:
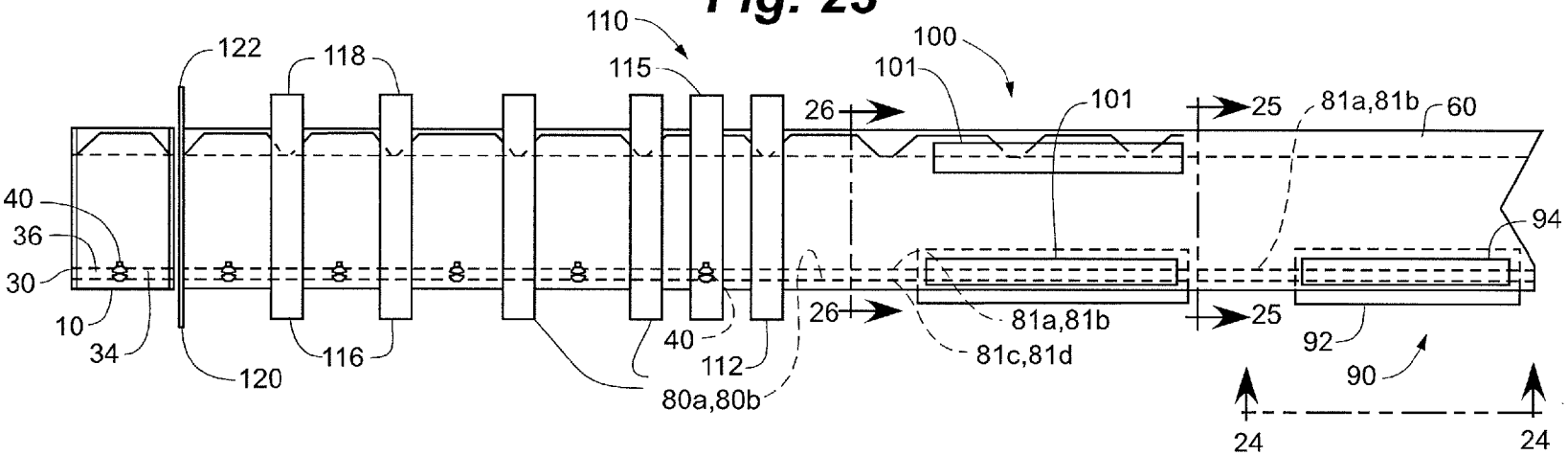
FIG. 23 is a top view of web sealing, cooling and cutting stations in accordance with an embodiment of forming a package.
Figure 24:
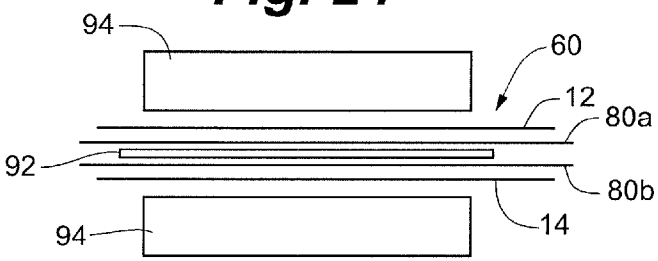
FIG. 24 is a side view of the web of FIG. 23 showing a sealing method.
Figure 25:
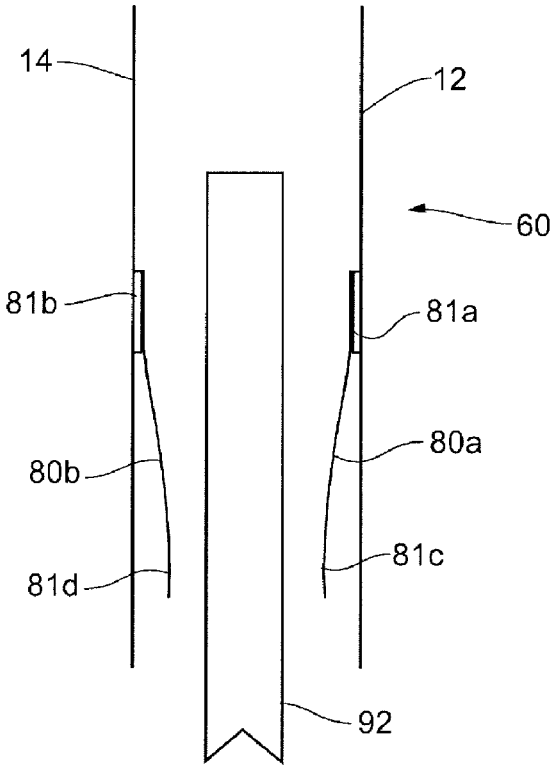
FIG. 25 is a cross-section view of the web of FIG. 23 showing sealed edges of fluid chambers.

The main web 10 and the chambers 80*a*, 80*b* will then be pulled along the machine to a longitudinal sealing station 90, where the chambers 80*a*, 80*b* can be separated by one or more plates 92 (e.g., a Teflon-coated plate), as shown in FIGS. 23-24. The chambers 80*a*, 80*b* are generally positioned so that the front panel portion 12 and one of the chambers 80*a*, 80*b* are over, or on top of, the plate 92 and the back portion 14 and the other of the chambers 80*a*, 80*b* are under the plate 92. Two opposing heated seal bars 94 can be positioned above and below the plate 92 and cycled to contact the web 60 (e.g., panels 12, 14) and cycled away from the web 60. The heated seal bars 94 can be positioned to seal edges of the chambers 80*a*, 80*b* to the main web portions 12, 14. As shown in FIG. 25, longitudinal edges 81*a*, 81*b* of the chambers 80*a*, 80*b* can be sealed first, with the other edges 81*c*, 81*d* remaining unsealed to permit later introduction of fluid or spacing members 130, 132. The plate 92 between films or layers ensures the chambers 80*a*, 80*b* do not seal to themselves during this operation. In alternate embodiments, excess portions or sections of the web portions 12, 14, or other parts of the package 10 or main web 60, can be utilized as the material or layer for the chambers 80*a*, 80*b*. For instance, a section of the main web portions 60 or panel portions 12, 14 can be folded down over or onto itself and sealed to create the chambers 80*a*, 80*b*.

Figure 26:
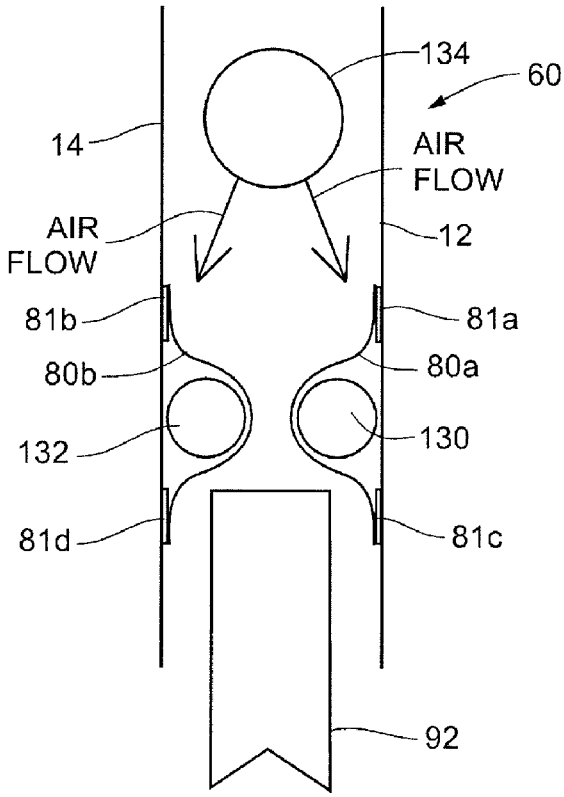
FIG. 26 is a cross-section view of the web of FIG. 23 showing shaping and sealed edges of fluid chambers.

During a subsequent sealing operation 100, bottom gusset seal 101 bars contact the main web 60 and seal the bottom gusset corner seals of the web 60 together. This sealing station 100 can also seal the top web 12 to the bottom web 14 through the apertures in the bottom gusset 16. Further, additional shaping or forming of the chambers 80*a*, 80*b* can occur at this operation by introducing the fluid or spacing members 130, 132. As shown in FIG. 26, the spacing members 130, 132 are positioned such that the chambers 80*a*, 80*b* lay over or around a portion of the members 130, 132, with the previously free edges 81*c*, 81*d* of FIG. 25 being sealed to the respective panel portions 12, 14 of the web 60. This sealing step provides at least the longitudinal shape for the chambers 80*a*, 80*b* and can itself provide the space and confines for the fluid, such as air, for the chambers. In one embodiment, the spacing members 130, 132 can be tubes or other similar devices, and can include one or more apertures adapted to inject or introduce air into the chambers 80*a*, 80*b*. In addition, a directional air member or tube 134 can be employed at this or other stages in the formation process to direct or push the free edges 81*c*, 81*d* down or over the members 130, 132 prior to sealing of the edges 81*c*, 81*d* to the respective panels 12, 14 of the web 60. Other means and techniques for introducing fluid into the chambers 80*a*, 80*b* and shaping and feeding the chambers 80*a*, 80*b* known to one skilled in the art can be employed without deviating from the spirit and scope of the present invention. For instance, air can be introduced through blasts or other techniques during any of the sealing steps (e.g., 90, 100 and 110) or another step along the formation process.

The webs will then be pulled further down the machine to a cross-sealing station 110, where one or more cross-seal bars 112 are positioned. Like with the longitudinal sections, there are generally opposing top and bottom bars 112. Instead of being longitudinal to the web or machining direction, bars 112 are generally positioned across, or transverse, to the web direction. A sealing bar 115 can seal the air-restriction channel between each half of the package 10 to define the regulator 40 portion, or a portion thereof. This seal can also seal the top web 12 to the bottom web 14 through the chambers 80*a*, 80*b* at the same time it is forming the air-restriction channels. At this same section, or at another station such as station 90 or 100, air can be introduced into the two chambers 80*a*, 80*b* (again, to be 33*a*, 33*b* of the separated final package 10) and another set of seal bars 112 seal the opened edges of the chambers 80*a*, 80*b* and side edges of the package 10 together. As such, the chambers 80*a*, 80*b* are divided up into the reservoir portions 34 and the closure portions 36 described herein, with the fluid regulator 40 disposed therebetween. Alternatively, a valve device known in the art can be introduced or pre-applied along a portion of the chambers 80*a*, 80*b* to define the regulator 40. Other devices and methods for fluid regulation and formation of such into the package 10 or web 60 are envisioned for use with the present invention as well. Again, a Teflon coated plate can be positioned between the chambers 80*a*, 80*b* to keep portions of them from sealing to themselves. In one embodiment, air can be introduced by means of an air blast, timed just before, or while, one or more of the seal bars 94, 112, or 115 come into contact with the web material. This controlled blast of air can be delivered through a tube (not shown) in or on the seal bars 94, 112, or 115. Other methods and techniques of introducing air are envisioned as well. The end of the air delivery tube can be located just inside the open side of the chambers 80*a*, 80*b*. This will leave a small un-sealed area of the now inflated chambers 80*a*, 80*b* that will be sealed off with one of the seal bars at a section of the bar that does not have a contour milled in it.

The seal bars can be approximately 25 inches long and designed to hit the same area of the material to be sealed (e.g., hitting the material two or more times). Because of bar length, the ability to seal around an air inflating tube with the first hit of the seal bar, and to then be able to seal off the gap left unsealed from the air inflation tube with the next contact on the web with the same bar, can all be accomplished with the same sealing bar in the same sealing station. Other techniques, devices, and methods of sealing and inflation can be utilized as well without deviating from the spirit and scope of the present invention. Again, the seal bars 112 can be employed to provide the side seals 16, 18 of the package 10, as shown in FIG. 23. These seals 16, 18 will also seal the top web 12 to the bottom web 14 through the chambers 80*a*, 80*b*. This is possible because of the sealant layer on each side of the barrier layer in the chambers 80*a*, 80*b*.

The next station 116 can include cooling bars 118 which will serve to cool off the side seals 16, 18, as shown in FIG. 23. Lastly, a cutting station 120, can include a cutting blade 122, or guillotine knife, that will cut off the individual pouches/packages from the continuous web 60 to define the distinct packages 10 with chambers 33*a*, 33*b* to create the fluid actuated closure.

There are several positions throughout the machine/formation process where other features or devices like tear notches, handles, hang-holes, graphics, valves, and the like can be added to the package 10. As such, known techniques, devices, and methods of formation are envisioned for use with the inventive package 10.

The present invention may be embodied in other specific forms without departing from the spirit or essential attributes thereof, and it is, therefore, desired that the present embodiment be considered in all respects as illustrative and not restrictive. Similarly, the above-described methods and techniques for forming the present invention are illustrative processes and are not intended to limit the methods of manufacturing/forming the present invention to those specifically defined herein. A myriad of various unspecified steps and procedures can be performed to create or form the inventive package 10.

What is claimed is:

1. A package for holding material, the package comprising:

a first panel portion;

a second panel portion, at least the first and second panel portions defining a top seal, first and second side seals, and an interior cavity, with an access opening defined from the first side seal a length short of the entire length of the top seal upon removal of at least a portion of the top seal; and a first panel fluid containment chamber containing a gas, the fluid containment chamber constructed of a film material to define a generally convex bubble portion provided along a portion of the first panel portion below the top seal to extend inward at the access opening such that the generally convex bubble portion blocks the access opening.

2. The package of claim 1, wherein the gas is air.

3. The package of claim 1, wherein the first panel fluid containment chamber includes a reservoir portion, with the gas movable from the reservoir portion to the generally convex bubble portion to selectively block the access opening.

4. The package of claim 1, wherein the package is constructed of a generally flexible material.

5. The package of claim 1, further including a second panel fluid containment chamber provided along a portion of the second panel portion below the top seal.

6. The package of claim 5, wherein the generally convex bubble portion of the first panel fluid containment chamber operably abuts the second panel fluid containment chamber to selectively block the access opening.

7. The package of claim 5, wherein the second panel fluid containment chamber includes a reservoir portion and a closure portion in fluid communication, with a gas movable from the reservoir portion to the closure portion of the second panel fluid containment chamber.

8. The package of claim 1, further comprising a handle portion.

9. The package of claim 8, wherein the handle portion includes an aperture defined through a portion of the package.

10. The package of claim 1, further comprising a bottom panel portion extending between and generally transverse to the first and second panel portions.

11. The package of claim 10, wherein the bottom panel portion is gusseted to facilitate generally upright standing of the package.

12. The package of claim 3, further including a narrow channel to facilitate movement of the gas from the reservoir portion to the generally convex bubble portion to selectively block the access opening.

13. The package of claim 1, wherein the access opening has a width approximately half the length of the top seal.

14. The package of claim 1, wherein the first panel fluid containment chamber is an integral part of the first panel.

15. A flexible package, comprising:

a first panel portion having an interior surface and an exterior surface;

a second panel portion having an interior surface and an exterior surface, at least the first and second panel portions defining a top seal and an inner portion of the package, with an access opening defined smaller than the length of the top seal; and a first fluid chamber constructed of a film material to define a generally convex bubble portion disposed along a portion of the interior surface of the first panel portion below the top seal to extend inward and oppose the interior surface of the second panel portion, the first fluid chamber further including a reservoir portion such that a fluid within the reservoir portion is selectively movable to the generally convex bubble portion to selectively block the access opening.

16. The package of claim 15, wherein the fluid is a gas.

17. The package of claim 15, wherein the second panel portion includes a second fluid chamber disposed along a portion of the interior surface of the second panel portion and opposing the first fluid chamber.

18. The package of claim 17, wherein the generally convex bubble portion of the first fluid chamber operably abuts the second fluid chamber to selectively block the access opening.

19. The package of claim 15, further comprising a gusseted bottom panel portion extending between the first and second panel portions to facilitate generally upright standing of the package.

20. The package of claim 15, wherein the first panel portion is a front panel portion of the package and the second panel portion is a back panel portion of the package.

21. The package of claim 15, wherein the top seal includes a tear portion adapted to tear away a length of the top seal to provide access to the access opening.

22. The package of claim 15, wherein the access opening has a width less than half of the length of the top seal.

23. The package of claim 21, wherein the tear portion is adapted to tear along an entire length of the top seal.

* * * * *